US008276296B2

(12) United States Patent
Frederick et al.

(10) Patent No.: US 8,276,296 B2
(45) **Date of Patent: *Oct. 2, 2012**

(54) DYNAMICALLY MODERATED SHOCK ATTENUATION SYSTEM

(75) Inventors: Edward Frederick, Brentwood, NH (US); Lenny M. Holden, Trabuco Canyon, CA (US); Jeremy Determan, Newport Beach, CA (US)

(73) Assignee: Pierre-Andre Senizergues, Newport Beach, CA (US)

( * ) Notice: Subject to any disclaimer, the term of this patent is extended or adjusted under 35 U.S.C. 154(b) by 566 days.

This patent is subject to a terminal disclaimer.

(21) Appl. No.: 12/498,250

(22) Filed: Jul. 6, 2009

(65) Prior Publication Data

US 2009/0300949 A1 Dec. 10, 2009

Related U.S. Application Data

(63) Continuation-in-part of application No. 11/673,777, filed on Feb. 12, 2007, now Pat. No. 7,788,826, and a continuation-in-part of application No. 11/673,792, filed on Feb. 12, 2007.

(51) Int. Cl.
*A43B 13/12* (2006.01)

(52) U.S. Cl. ..... 36/28; 36/30 R; 36/44; 36/88

(58) Field of Classification Search ..... 36/28, 30 R, 36/44, 93, 88, 25 R
See application file for complete search history.

(56) References Cited

U.S. PATENT DOCUMENTS

| | | | | |
|---|---|---|---|---|
| 4,183,156 | A | 1/1980 | Rudy | |
| 4,486,964 | A | 12/1984 | Rudy | |
| 4,506,460 | A | 3/1985 | Rudy | |
| 5,741,568 | A | 4/1998 | Rudy | |
| 5,854,143 | A | 12/1998 | Schuster et al. | |
| 6,701,529 | B1 | 3/2004 | Rhoades et al. | |
| 6,913,802 | B1 | 7/2005 | Plant | |
| 7,020,988 | B1 | 4/2006 | Holden et al. | |
| 7,788,826 | B2 * | 9/2010 | Frederick | 36/28 |

FOREIGN PATENT DOCUMENTS

GB 2349798 11/2000

OTHER PUBLICATIONS

Dow Corning, "Superior Defense and Comfort for High-Performance Apparel and Accessories", 2 pages.
WWW.TECHTEXTILES.COM, "T3 Technical Textile Technology", Apr. 2006, 4 pages.

* cited by examiner

*Primary Examiner* — Marie Patterson
(74) *Attorney, Agent, or Firm* — Stetina Brunda Garred & Brucker

(57) ABSTRACT

Various embodiments of this invention disclose a dynamically responsive shock attenuation system for footwear and/or apparel that comprises two or more materials with different, narrowly prescribed physical properties, which, when used together, produce a dynamic, continuous, and proportional response over a wide range of impact forces. In various embodiments of the invention, the two materials comprise a first material that exhibits generally Newtonian behavior to impact forces and a second material that exhibits generally non-Newtonian behavior to impact forces.

13 Claims, 5 Drawing Sheets

DYNAMICALLY MODERATED SHOCK ATTENUATION SYSTEM

CROSS-REFERENCE TO RELATED APPLICATIONS

This is a continuation in part application of U.S. patent application Ser. Nos. 11/673,777 now U.S. Pat. No. 7,788,826 and 11/673,792, both filed on Feb. 12, 2007, now pending, the entire contents of which are expressly incorporated herein by reference.

FIELD OF INVENTION

The present invention relates to footwear or articles of clothing having a shock attenuating cushioning system.

BACKGROUND

For footwear, cushioning systems are designed to be capable of attenuating a wide range of impact force magnitudes. Ordinary impact forces in walking and running, for example, vary between approximately 600 Newtons (N) and 2500 N. However, values as high as 15,000 N have been measured as a consequence of certain extreme maneuvers, for example, in the sport of skateboarding. (See: "Impact Forces During Skateboarding Landings," J. Determan, et al., Proceedings, Thirteenth Biennial Conference, Canadian Society for Biomechanics, Halifax, Aug. 4-7, 2004, page 28). Because the magnitudes of these forces are dependent on body mass, for convenience, impact force data is often normalized to body weight ((body mass)×(acceleration due to gravity)) and described as multiples of body weight. In this manner, these impact forces can be described as varying between approximately 1 Body Weight (BW) and up to and exceeding some 20 BW, in extreme cases.

Because of the wide range of impact forces that athletes experience while practicing their sport, particularly forces involved in high-impact or extreme sports such as skateboarding, no single conventional shock absorption system will satisfy all of athletes' needs. Ordinary impact forces, which may range from 1 BW to 5 BW, such as those experienced in walking, running, and other non-extreme sports, are also encountered in extreme sports, such as skateboarding. The majority of impact forces that skateboarders encounter, for example, are in the range from approximately 1 BW to 5 BW. However, oftentimes during a typical day of skateboarding, extreme impacts on the order of 6 BW to more than 15 BW may be generated in attempting and performing maneuvers that involve large vertical displacements.

Shock attenuating systems that address moderate, ordinary impacts are generally not suitable for extreme impacts due to limitations on physical properties of common shock attenuating systems. For example, one common shortcoming is that these systems reach their displacement limit or "bottom out."

One common type of material used in athletic shoe shock attenuating systems, polymeric foams, receive their shock attenuating properties principally from the many small gas bubbles trapped in the foam's polymeric matrix. They operate similarly to an inflated shock attenuating system that works by trapping air in a bladder. When a typical polymeric foam, or similar air inflated shock attenuating system, is exposed to high impact forces, the gases within are compressed and reach their displacement limit, thus, becoming non-compliant and ceasing to provide further shock attenuation. The same problem exists for other shock absorbing systems that are more structural in nature, such as springs or molded plastic structures.

Some designs have sought to improve upon the above shortcomings by utilizing a structure that is stiffened or enlarged, or, in the case of foams or inflated systems, the gas volumes and pressures in certain materials have been raised to a high enough level to be able to accommodate higher impact forces. At ordinary levels of impact, however, the resulting systems may often be too thick or too stiff and uncomfortable. Thus, generally speaking, conventional shock-attenuating systems suffer from being useful over only a narrow range of impact forces and tend to have undesirable physical properties when impacted outside that narrow range. Thus, these systems are undesirable for extreme sports, such as skateboarding, where shock attenuation is needed for a very broad range of impact forces.

For apparel, shock attenuating systems have been used in innumerable applications for centuries in order to protect the body from a wide range of impacts. The classic problem for designers of apparel-related shock attenuating systems has been the development of cushioning systems that protect against a broad range of impacts while remaining comfortable and flexible enough to allow unencumbered movement of the body. This problem is illustrated by medieval plate armor, for example, which provides good protection from sharp impacts but minimal protection from blunt impacts. Moreover, medieval plate armor provides insufficient flexibility to allow the wearer to make quick, agile movements, and it is too uncomfortable to be worn for long periods of time.

Other types of shock attenuating systems for apparel that are used in sports experience similar shortcomings. Soccer shin-guards, for example, illustrate the shortcomings of an area-elastic system in providing shock attenuation to a broad range of impact forces. Soccer shin-guards typically comprise an outer layer made of a hard plastic material and an inner thin layer of foam or padded, compressible cushioning material. The soft cushioned layer mainly compensates for morphological variability on the surface of the shin area as these cushioning layers are too thin to provide significant shock attenuation. The outer stiff layer provides impact protection at low impact loads by acting like an area-elastic system and distributing the forces of impact over a broader area. However, when the shin-guard experiences a firm impact, the cushioning reaches its deformation capacity and no longer protects the wearer. Thus, the shin-guard is rendered inadequate because the cushioning layer bottoms out and the hard plastic layer firmly impacts the wearer's shin, creating regions of instantaneous high pressure where the hard plastic pushes against boney prominences.

Also, attire or padding worn in or under football uniforms experiences many of these same shortcomings. Under severe impacts, the pads that are worn to protect football players' bodies are compressed to their maximum capacity and no longer provide impact protection to the body. When stiffer pads are substituted for soft ones, they do not provide impact protection to less severe forces because the padded materials do not compress. Further, because cushions and pads operate, generally speaking as point-elastic systems, they do not provide significant protection from sharp, focused impacts. For example, while a soft football pad may soften the impact of a fall, it will do little to attenuate the impact of a strike from a sharply pointed object, such as an elbow.

Helmets that are worn in sports and in other applications to protect the wearer's head suffer from many of these shortcomings. Helmets typically feature a hard, outer shell and cushioned padding on the inside. The padding serves to attenuate relatively soft impacts while the shell protects against more harsh impacts. When the padding or cushioning reaches its displacement limit, however, it no longer serves to attenuate impact forces. Thus, forces that are sufficient to compress the padding are transmitted from the hard shell to the wearer's head.

Soft padded layers by themselves are therefore inadequate for protecting the body from high-pressure-producing impact from sharp objects. Hard and stiff layers are better at distributing the forces of sharp impacts but they are cumbersome and inhibit comfort and performance. In addition to being cumbersome, stiff shell-like padding systems have another common flaw.

This flaw in the design of most impact protection systems that attempt to use a hard outer layer to distribute forces is most apparent when they are tasked to protect anatomical regions where the layers of soft tissue are thin and do not offer much biological padding. These boney areas are the shin, elbow, knee, wrist, ankle, chin and other areas of the head. A sharp impact to one of these areas often is transmitted though the stiff outer layer directly applying high-pressure impact forces to the boney structures. The main reason for this is the variability in the morphology of the underlying boney structures.

The shapes of the boney regions over the knees, elbows, shins and so on vary from person to person and from left to right within the same person. These natural irregularities in individual morphology create high points in the individual's anatomy. Even if the hard shell of the padding is contoured to follow the approximate shape of the anatomy of the boney area, it can not follow the contours of each person's unique morphology. This means that, when high impact forces are transmitted via the shell to boney areas, high-pressure hot spots inevitably result. This is a major flaw of the hard shell approach.

Often a thin layer of foam will be added to compensate for these morphological irregularities, but as noted above, these thin layers of compressible material bottom out and the hot spot problem presents itself albeit at a slightly higher force level.

Designers of shock attenuating systems for attire are challenged to develop shock attenuating systems that adequately address the morphological irregularities over boney regions when both moderate impacts as well as more harsh impacts are experienced. On top of these requirements is the need to design padding for apparel that does not encumber the movements of athletes. Because of the shortcomings discussed above, there remains a long felt need in the art for a shock attenuating system whose resistance is dynamic over a wide range of impact forces. That is, a shock attenuating padding system that is flexible in the absence of impact forces and that provides impact protection to a broad range of impacts while adjusting to attenuate the effects of the impacts proportionally to the degree of the impact is highly desirable in the art.

For both apparel and footwear, shock attenuating systems may be generally described in terms of point-elastic and area-elastic systems. A point-elastic shock attenuating system deforms non-uniformly (see FIG. 1). That is, for example, the greatest compliance is found under the area of highest pressure and the amount of deformation of the shock-attenuating layer varies in proportion to the distribution of forces over its surface. Standing on an inflated air mattress is an example of point-elastic behavior; the area just beneath the foot where pressures are high shows the greatest deformation while other areas show little or no deformation. Meanwhile, an area-elastic system distributes forces over a wider area causing a much greater area of the shock attenuating structure that is engaged in shock attenuating (see FIG. 2). A stiff sheet of plywood laid over an inflated air mattress is an example of an area-elastic system, because the forces applied by standing on the plywood are distributed over a much larger portion of area of the air mattress.

In order to improve upon these conventional shock-attenuating systems, several systems have been developed using combinations of shock absorbing materials in order to provide shock absorption over a broader range of impact forces. U.S. Pat. No. 4,506,460 to Rudy, for example, discloses the use of a stiff moderator to distribute the forces of impact over a larger area of the shock attenuating system. The use of such moderators, however, further restricts the range of impact shocks that can be accommodated because the stiff moderator is limited in its shock absorbing abilities. While successfully distributing forces over a wider area, the stiff moderator fails to adequately absorb high impact forces. Another approach to providing shock attenuation is disclosed by U.S. Pat. No. 4,183,156 to Rudy. Rudy's patent discloses an air cushion for shoe soles that uses a semi-rigid moderator in order to distribute the loads over the air cushion. While moderating the cushioning forces, this system suffers from some of the same shortcomings as that of the area-elastic systems discussed above. Also, the patent fails to disclose a method for providing dynamic moderation of the forces.

Another such spring moderator is disclosed by U.S. Pat. No. 4,486,964 also to Rudy. The '964 patent discloses the use of a moderator having a high modulus of elasticity over a cushioning material. The '964 patent, however, fails to disclose the use of a non-Newtonian material as an improved, dynamic moderator. A cushioning system that utilizes a stiff layer of material sandwiched between two foam, midsole layers is disclosed by U.S. Pat. No. 4,854,057 to Misevich et al. Misevich's patent, however, fails to disclose a cushioning system that uses the advantageous features of both Newtonian and non-Newtonian materials.

Another such system is disclosed by U.S. Pat. No. 5,741,568 also to Rudy. Rudy's '568 patent discloses the use of a fluid filled bladder surrounded by an envelope, in order to combine the properties of compressible padding materials with the effects of fluid materials.

The use of non-Newtonian materials, particularly dilatant materials, has also been used in shock attenuating systems, in order to provide a broader range of impact force attenuation. A non-Newtonian material is a material, often a fluid or gel or gel-like solid, in which the stiffness of the material changes with the applied strain rate. Newtonian materials, meanwhile, are said to behave linearly in response to strain rate so their stiffness is constant over a wide range of strain rates.

Most materials used in shock attenuating systems are somewhat viscoelastic and are not perfectly Newtonian, but the degree to which they are sensitive to the rate of loading is negligible when compared with materials with distinctly non-Newtonian properties.

"Newtonian materials" as we define them for the purposes of this invention, are compliant shock attenuating materials with predominately linear load displacement characteristics. Such Newtonian materials may demonstrate some non-linear properties in imitation of non-Newtonian properties, but they are essentially linear in their load displacement behavior. Furthermore, any distinctly non-Newtonian behavior of these materials can be explained by bottoming out, or, by extreme physical deformation of the material, and not by the fundamental physical and chemical properties that create the character of truly "non-Newtonian materials."

Materials that qualify for use as Newtonian in an effective cushioning system must be compliant enough to attenuate peak impact forces. Compliance in this context is the strain of an elastic body expressed as a function of the force producing that strain. Compliant shock attenuating systems in footwear are used to decelerate the mass that is producing peak impact forces. These compliant materials yield to the force of impact, but resist with proportional stiffness to decelerate the impacting mass in a controlled manner, thus reducing peak forces, and delaying the time to peak impact. Therefore, an effective Newtonian material must be relatively linear in its load displacement properties, but also compliant enough and thick enough to significantly attenuate peak impact forces. A non-compliant material would not be able to attenuate peak forces, and a material that was compliant, but too thin, would bottom out and be inadequate as a shock attenuating material.

Non-Newtonian properties, meanwhile, are commonly described as either dilatant or pseudo-plastic. Dilatant materials demonstrate significant increases in stiffness as loading rate increases. Pseudo-plastic materials, on the other hand, show the opposite response to increased rates of loading, i.e., their stiffness decreases as loading increases.

U.S. Pat. No. 6,701,529, to Rhoades et al. and U.S. Pat. No. 5,854,143, to Shuster et al., disclose the use of dilatant materials to moderate the impact forces of a fall or of a ballistic collision. Neither of these patents, however, discloses the use of dilatant materials in combination with a layer of shock absorbing material for attenuating shocks over a broad range of impact forces. What is more, at higher rates of loading and higher force magnitudes, these dilatant materials by themselves would be relatively stiff and non-compliant. Thus, the use of these materials would be undesirable in applications where attenuation of high impact forces is required. Using a dilatant material by itself means that higher impact loads induce an instantaneous increase in stiffness that make the material less shock attenuating. Accordingly, the dilatant material when used by themselves, may be less useful as a shock attenuating material. At the very instant that they need to provide the greatest amount of compliance and shock attenuation, they are less compliant and less shock attenuating.

The device shown and described in U.S. Pat. No. 6,913,802 appears to disclose a dilatant material that is used by itself to attenuate shocks. Foam appears to be attached to the dilatant material but does not appear to serve the purpose of shock attenuation. In support thereof, Col. 4, Lines 5-8 of the '802 application describes the foam as increasing comfort for the wearer.

Another approach to using a combination of materials for shock attenuation is disclosed by U.S. Pat. No. 7,020,988 to Holden et al. Holden's invention discloses a shock attenuating system wherein a system used to attenuate the lower range of impacts is used in combination with a non-compressible second system that is engaged and allowed to provide shock attenuation for the higher range of impacts. Thus, this system allows for both extreme and ordinary impacts to be attenuated. This combined system, however, remains limited by the narrow physical properties of the two individual systems that have been selected for use. Also, the response of the combined system is limited because the two-component system is somewhat discontinuous in its shock attenuating properties.

Thus, there remains a long felt need in the art for a shock attenuating system that is responsive to a broad range of impact force magnitudes, that provides attenuation fairly continuously over a wide range of forces, and that responds to these forces proportionally and adjusts automatically to the actual impact load that it is called upon to absorb.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

Figure 1:
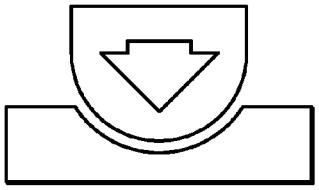
FIG. 1 (PRIOR ART)
FIG. 1 is an illustration of a prior art point elastic system.
Figure 2:
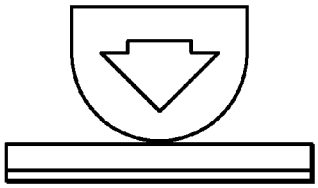
FIG. 2 (PRIOR ART)
FIG. 2 is an illustration of a prior art area elastic system.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another.

Furthermore, the reference or non-reference to a particular embodiment of the invention shall not be interpreted to limit the scope the invention.

In the following description, certain terminology is used to describe certain features of one or more embodiments of the invention. For instance, "shoe" refers to any of the various coverings for the human foot, including shoes, boots, sandals, and similar such items known within the art; "sole" refers to the base of any shoe made of rubber, plastic, or other such materials known within the art; "midsole" refers to any midsole, insole, or other middle layer of the sole of a shoe. Also, "apparel" refers to any of the various coverings and protectors for the human body including: shirts, undershirts, pants, underpants, hats, helmets, face guards, shin-guards, athletic supporters, groin protectors, gloves, hand pads, head guards, mittens, jerseys, shorts, deflectors, chest guards, throat protectors, spine protectors, knee-guards, boots, footwear, ankle protectors, shin guards, kidney belts, martial arts pads, leg pads, Thai pads, sparring pads, boxing gloves, boxing coaching pads, handlebar pads, hook and jab pads, football girders, rib pads, forearm pads, elbow guards, shoulder braces, harness pads, race guards, bicycle or motorcycle seats, chest protectors, back packs, hip pads, shoulder straps, wrist stabilizers, wrist pads, and other such items; "shock attenuating systems for attire" refers to any of the various devices used to dampen shocks or to prevent excessive pressure such as padding, cushioning, shock absorbing materials, pads, pillows, mufflers, or other such materials that are used integrally or removably with any of the above forms of attire.

One embodiment of the invention is directed towards improving upon the above shortcomings by disclosing a dynamically responsive shock attenuation system that automatically changes its mechanical properties in response to the level of force applied and the rate of loading of that impact force. One embodiment of the invention achieves these goals by utilizing a combination of two materials with different, narrowly prescribed physical properties that, when used together, produce a continuous and proportional response over a wide range of impact forces.

Figure 3:
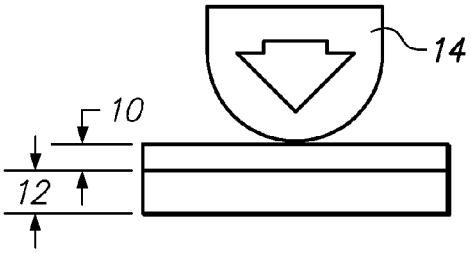
FIG. 3 is an illustration of a non-Newtonian material in combination with a Newtonian material.
Figure 4:
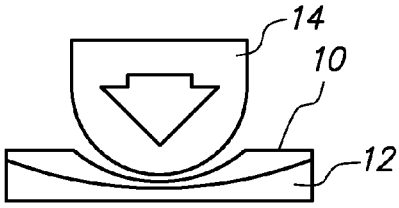
FIG. 4 is an illustration of the non-Newtonian material and Newtonian material in FIG. 3 with a light impact load.
Figure 5:
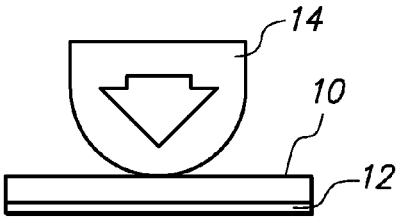
FIG. 5 is an illustration of the non-Newtonian material and Newtonian material in FIG. 3 with a high impact load.

In one embodiment of the invention, a proportional response is achieved by using a non-Newtonian material 10 in combination with a generally Newtonian material 12 (see FIG. 3) to produce a predictable varying moderating effect that causes the shock attenuation system to range between point-elastic and area-elastic in its physical properties, as shown in FIGS. 4 and 5.

For attire applications, the use of point-elastic shock attenuating systems in shock attenuating systems provides comfortable shock attenuation at relatively low impact forces. With higher impact forces, the narrow column of point-elastic shock attenuating material underlying the higher-pressure areas will reach its displacement limit or bottom out and will no longer provide adequate shock attenuation.

For footwear applications, two of the advantages of using point-elastic shock attenuating systems are that these systems have a cradling and laterally stabilizing effect, as shown in FIG. 4. This effect is especially created at the parts of the foot under the heel and ball of the foot at which pressures are relatively high. Such systems are generally supportive, stable, and comfortable at the narrow range of impact forces from approximately 1 BW to 5 BW, commonly encountered in non-extreme sports.

With higher impact forces, commonly encountered in extreme sports such as skateboarding, however, the relatively narrow column of shock attenuating material underlying the higher-pressure areas will reach its displacement limit, bottom out, and will no longer provide adequate shock attenuation.

The use of a moderator, similar to the stiff sheet of plywood mentioned in the example above, distributes the impact forces over the whole area of the shock attenuating material, which underlies the moderator. This creates an area-elastic system that is able to absorb higher impact forces because it can engage a much larger area and distribute the force over this larger area.

Nonetheless, the introduction of a stiff moderator, such as that disclosed by Rudy's '460 patent, above, introduces other undesirable limitations. For example, area-elastic systems are not as comfortable for the foot or as anatomically conformable as point-elastic systems, and area-elastic systems may be biomechanically unstable. More importantly for sports applications that require a wide range of impact attenuation, area-elastic systems have a limited range of effectiveness as shock attenuating systems. Thus, while an area-elastic system is capable of absorbing relatively higher impact forces, it may be considered too stiff and ineffective to absorb lower magnitude impact forces and, therefore, may be too uncomfortable for the wearer.

One embodiment of this invention improves upon these shortcomings by using non-Newtonian materials 10. By way of example and not limitation, by combining this dynamically responsive NNM 10 with a layer of compliant shock attenuating materials 12, a shock attenuation system is created that behaves in a point-elastic manner under low level impacts 14 (see FIG. 4) and in an area-elastic manner under high level impacts 14 (see FIG. 5).

Meanwhile, at intermediate impact levels, the system will mix point-elastic and area-elastic properties in proportion to the load and rate of loading, such that a relatively continuous shock attenuation range is created. That is, the system will adapt automatically to vary its shock attenuation properties in response to the level of impact forces 14. Thus, at intermediate levels, the invention allows for a gradual transition between point-elastic and area-elastic properties.

The cushioning layer 12 used in combination with the NNM 10 generally behaves in a Newtonian or linear manner in response to impact forces in order to best take advantage of the effects of the dynamically adjusting NNM layer.

In another embodiment of the invention, a shear thickening or dilatant material may be utilized within the moderator 10 to increase stiffness in proportion to the load, in order to create a progressively increasing shock attenuation system progressively increasing in stiffness. In yet another embodiment of the invention, a thixotropic material may be used in the moderator to produce a progressively decreased stiffness in response to high loads. Thixotropic materials generally exhibit time-dependent change in resistance such that the longer the materials undergoes shear, the lower their resistance.

Figure 6:
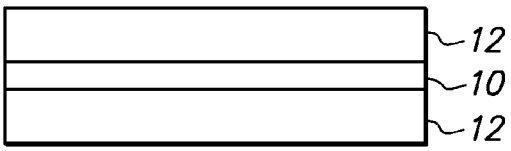
FIG. 6 is one embodiment of various moderators used in combination or tandem with one another to produce effects specific to the forces encountered on various parts of the foot under pressure.
Figure 7:
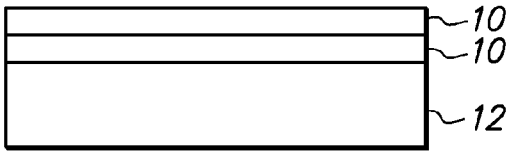
FIG. 7 is an alternative embodiment to the embodiment shown in FIG. 6.

These various moderators may be used in combination or tandem with one another to produce effects specific to the forces encountered on various parts of the foot under pressure (e.g., see FIGS. 6 and 7). In one embodiment of the invention, for example, dilatant materials are used for the heel of the foot while thixotropic materials are used for the forefoot. Also, these various moderators may be used in combination or tandem with one another to produce effects specific to the forces encountered on various parts of the body under pressure (e.g., see FIGS. 6 and 7). Naturally, the various materials may be tailored to the impacts encountered in the specific sports or industrial application for which the shock attenuating system is utilized.

One class of dilatant materials that may be used to produce the NNM is polyborosiloxanes. Other materials that are useful in the construction of the NNM and remain within the contemplation of this invention include, but are not limited to: rheopectic materials, thixotropic materials, pseudo-plastics, Bingham plastic materials, anelastic materials, yield pseudo-plastic, yield dilatant materials, and Kelvin materials. These and other materials may be adapted to the NNM to create biomechanically defined shock attenuation properties.

Some materials known in the art for constructing the Newtonian cushioning layer and that remain within the contemplation of the invention include, without limitation: inflated or gas-filled bladders, slabs of Ethylene Vinyl Acetate foam, Polyurethane and other conventional foam materials, gel or gel-like materials, structural plastic point-elastic cushioning systems, and other materials, known within the art, which provide a compliant shock attenuating layer that can function as an area-elastic or a point-elastic shock attenuating system when appropriately moderated by the NNM.

Figure 8:
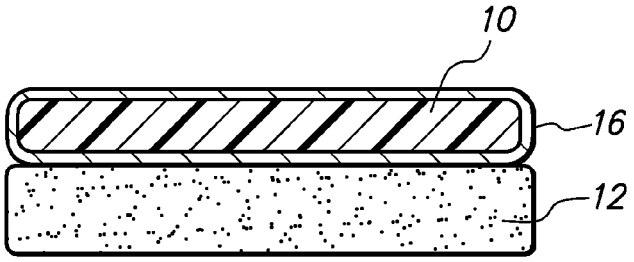
FIG. 8 is an illustration of an encapsulated non-Newtonian material which is used in combination with a Newtonian material.

In one embodiment of the invention, the NNM is encapsulated or otherwise contained such that its lateral expansion is limited, as shown in FIG. 8. An encapsulating material 16, generally speaking, should have a high degree of elasticity and resilience such that it does not interfere with or mask the physical properties of the non-Newtonian material 10. Some encapsulating materials that are known within the art and are within the contemplation of the invention include, without limitation: encapsulating film envelopes, sheets of plastic film or plastic film envelopes, polyurethane film envelopes, polymer based envelopes, woven fabric envelopes, and other such materials known within the art.

Figure 9:
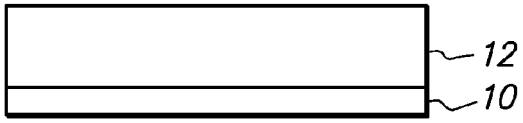
FIG. 9 is an illustration of a Newtonian material disposed above a non-Newtonian material.
Figure 10:
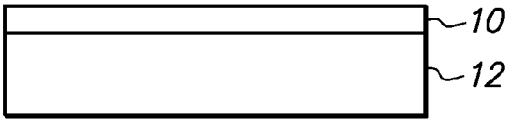
FIG. 10 is an illustration of a non-Newtonian material disposed over a Newtonian material.

It should be noted that the various embodiments of the invention are claimed without any specific claim to an orientation or configuration because the principles of the invention may be practiced in a number of orientations and configurations. For example, a Newtonian material 12 may be placed over a non-Newtonian material 10 (see FIG. 9), or visa-versa (see FIG. 10). Also, a non-Newtonian section may be included over a portion of a Newtonian shoe insole. These and other variations are known within the art and these various orientations and configurations remain within the contemplation of the invention.

It should further be noted that the principals of the invention may be practiced with any of the various shock attenuating mechanisms for footwear known in the art. The principals of the invention may, for example, be practiced with shoe insoles, midsoles, removable shoe insoles, shoe soles, and other such shock attenuating mechanisms for footwear known in the art.

Additionally, it should further be noted that the principals of the invention may be practiced with any of the various shock attenuating mechanisms for attire known in the art. The principals of the invention may, for example, be practiced with chest or shin guards that use integrated padding. The principals of the invention may also be used with padded that is removable from the apparel, such as the padding used in football girdles. Also, the principals of the invention may be practiced with freestanding shock attenuating articles such as handlebar padding or boxing coaching pads that are not directly attached to the body but are intended to interact with boney areas of the body when in use.

In an aspect of the invention, a shock attenuation system for footwear is provided. The system may comprise a multi-layered system comprising a first layer and a second layer. The first layer may comprise a moderating material that generally exhibits non-Newtonian behavior in response to impact force. The second layer may comprise a cushioning material that generally exhibits Newtonian behavior is response to the impact force. The shock attenuation system may comprise one or more of the shock attenuation systems taken from the group: shoe insoles; shoes midsoles; and removable shoe insoles. Also, the shock attenuation system for footwear may comprise a plurality of shock attenuation units. The shock attenuation units may each be composed of said multi-layered system comprising a first layer and a second layer. The number of said first layers comprising moderating materials that generally exhibit non-Newtonian behavior in response to impact forces and the number of said second layers comprising cushioning materials that generally exhibit Newtonian behavior is response to impact forces may be related by a 1:1 ratio.

In yet other applications, the principals of the invention may be applied to cushioning systems in helmets and other head protectors. Furthermore, the principles of the invention may be applied to shoulder straps in baggage, such as backpacks, in order to reduce the strain on the shoulder bones from heavy loads. Skiing and snowboarding equipment, such as boots and protectors, may also benefit from the application of various principals of the invention to the padding used within the boots and protectors. The dynamically moderated shock attenuating system may be used in these and several other apparel applications to provide protection to the wearer's body.

In summary, one embodiment of the invention comprises a shock attenuating system that is a combination of a compliant, Newtonian material, and a non-Newtonian moderator, that combine to produce a system that is responsive to a broad range of impact force magnitudes, provides attenuation fairly continuously over the range of forces, and responds to these forces proportionally to the actual impact load that it is absorbing.

Figure 11:
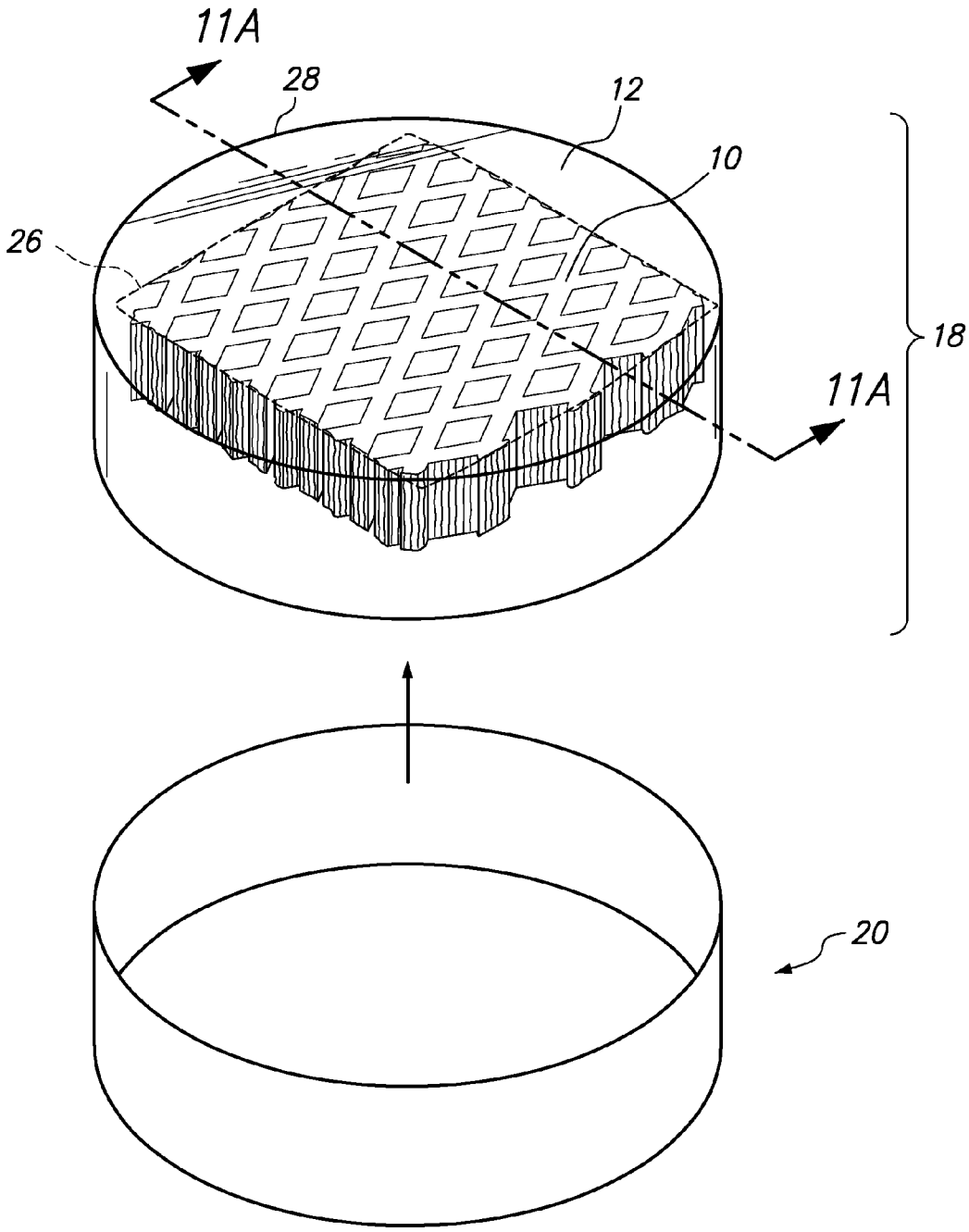
FIG. 11 is an illustration of a non-Newtonian material embedded within a Newtonian material.

In another embodiment of the Newtonian/non-Newtonian combination 18, a non-Newtonian material 10 may be embedded within a Newtonian material 12 (see FIG. 11). By way of example and not limitation, the Newtonian material 12 may be an elastomeric material such as a "solid gel" having a relatively moderate durometer and a relatively high dampening coefficient, i.e., a durometer on the shore "00 scale" if not less than 35, and a shore resiliometer rebound not greater than 35 percent, respectively. The elastomeric material may comprise polyvinyl chloride, polyurethane, synthetic rubber, olefin or silicone rubber and/or GELPACT, a trademark of Chase Ergonomics, Inc.

By way of example and not limitation, the non-Newtonian material 10 may have a mesh configuration with an open structure (see FIG. 11). The non-Newtonian material 10 may have a plurality of fibers that are held together by silicone coating. The plurality of fibers may have an open structure to allow air or the Newtonian material 12 to flow through the non-Newtonian material 10. The fibers may be aligned vertically or parallel to the direction of the impact force. Additionally, as will be discussed below, the open structure also permits a Newtonian material 12 in the form of a liquid to flow through the open structure. The non-Newtonian material 10 may be a material sold under the trademark ACTIVE PROTECTION SYSTEM or ACTIVE PROTECTION SYSTEM S7-005 both sold by Dow Corning.

As shown in FIG. 11, the non-Newtonian material 10 may have a square configuration when viewed from the top. However, it is also contemplated that the outer periphery 26 of the non-Newtonian material 10 may have other configurations such as round, triangular, star shaped, etc. To embed the non-Newtonian material 10 into the Newtonian material 12, the Newtonian material 12 may be provided in liquid form.

The Newtonian material 12 may be poured into a mold 20 while the Newtonian material 12 is still in the liquid form, the non-Newtonian material 10 which has a mesh configuration may be pushed into the liquefied Newtonian material 12 within the mold 20. Conversely, the non-Newtonian material 10 may initially be placed within the mold 20. Thereafter, the liquid Newtonian material 12 may be poured over the non-Newtonian material 10 until the entire non-Newtonian material 10 is disposed within the liquid Newtonian material 12. In both instances, the Newtonian material 12 is allowed to cure or set with the non-Newtonian material 10 disposed therein. The Newtonian/non-Newtonian material combination 18 is then removed from the mold 20.

Figure 12:
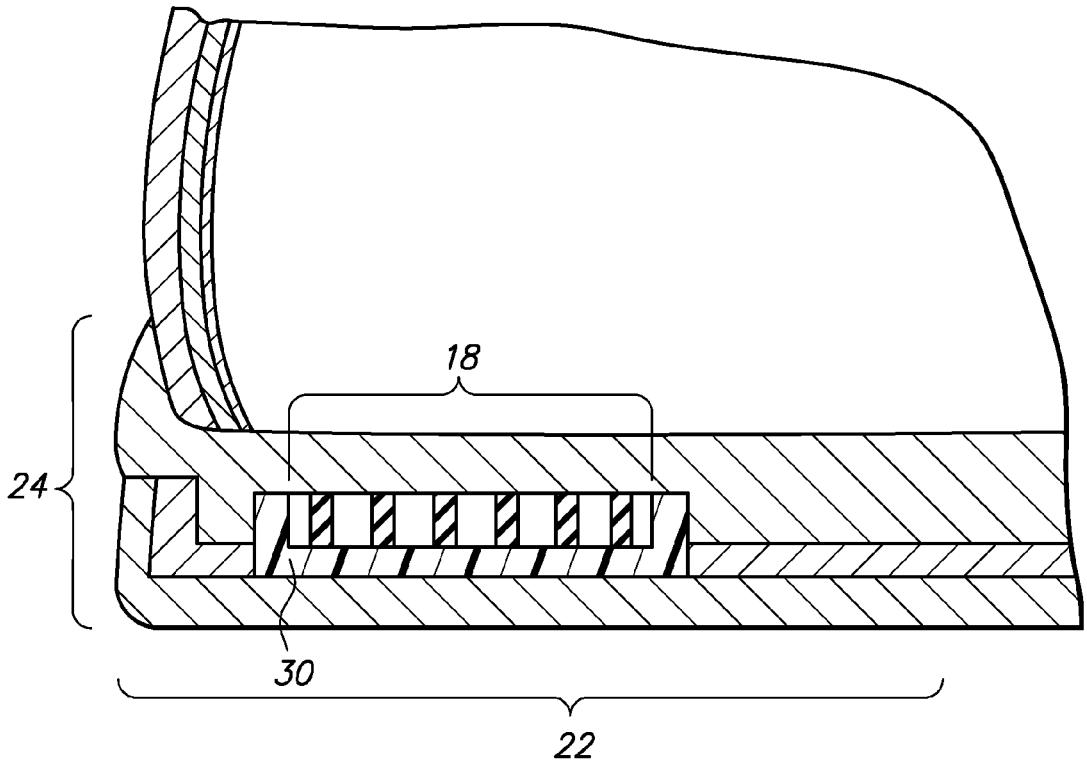
FIG. 12 is a cross sectional view of a footwear with the non-Newtonian material and Newtonian material shown in FIG. 11 is disposed within a heel of the footwear.

Referring now to FIG. 12, the Newtonian/non-Newtonian material combination 18 may be generally disposed within a heel 22 of a footwear 24. The Newtonian/non-Newtonian material combination 18 may be disposed within a recess supported by material 30 that is generally more rigid compared to the Newtonian material 12. The outer periphery 26 may be gapped away from an outer periphery 28 of the Newtonian material 12, as shown in FIG. 11.

Figure 11A:
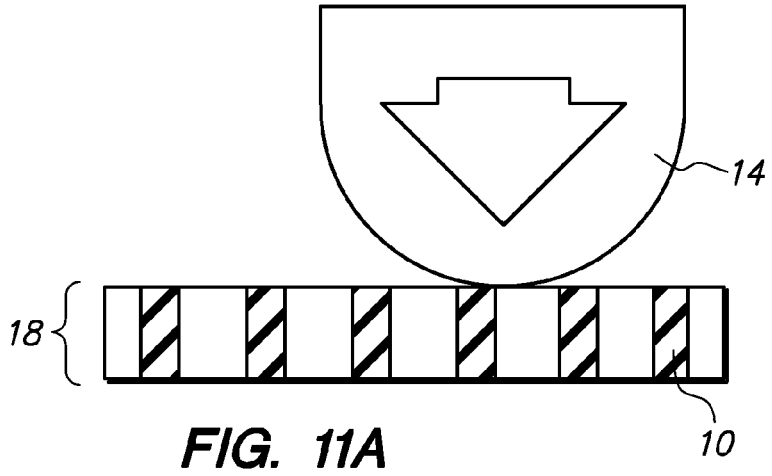
FIG. 11A is a cross sectional view of the non-Newtonian material and Newtonian material shown in FIG. 11 with a light impact load.
Figure 11B:
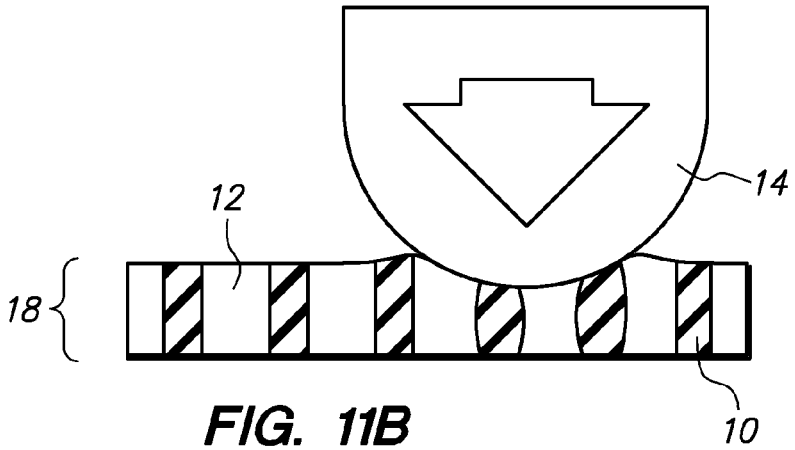
FIG. 11B is a cross sectional view of the non-Newtonian material and Newtonian material shown in FIG. 11 with a high impact load.

Referring now to FIG. 11A, which is a cross sectional view of a Newtonian/non-Newtonian material combination 18 shown in FIG. 11, a high impact force 14 is shown. The high impact force 14 may be a heel of a person's foot while the person is running. As shown, the non-Newtonian material 10 stiffens to absorb more of the high impact force 14. As such, the Newtonian/non-Newtonian material combination 18 behaves as an area elastic system. In contrast, as shown in FIG. 11B, when a low impact force 14 is imposed upon the Newtonian/non-Newtonian material combination 18, the Newtonian/non-Newtonian material combination 18 behaves more linearly or more like the Newtonian material 12. As such, the Newtonian/non-Newtonian material combination 18 behaves more like a point elastic system.

Figure 11C:
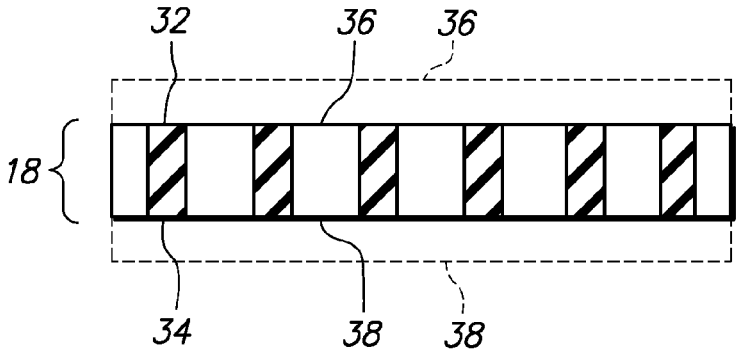
FIG. 11C is an alternative embodiment of the non-Newtonian material and Newtonian material shown in FIG. 11 wherein a layer of Newtonian material is optionally disposed above an upper surface of the non-Newtonian material and optionally disposed below a lower surface of the non-Newtonian material.

Referring now to FIG. 11C, an alternative embodiment of the Newtonian/non-Newtonian material combination 18 is shown. In one embodiment, an upper surface 32 and a lower surface 34 of the non-Newtonian material 10 is coplanar with an upper surface 36 of the Newtonian material 12 and a lower surface 38 of the Newtonian material 12. This is shown in solid lines. It is also contemplated that the upper surface 32 of the non-Newtonian material 10 and/or the lower surface 34 of the non-Newtonian material 10 may be disposed entirely within the Newtonian material 12 in that the upper surface 32 of the non-Newtonian material 10 is below the upper surface 36 of the Newtonian material 12 and/or the lower surface 34 of the non-Newtonian material 10 is above the lower surface 38 of the Newtonian material 12, as shown in FIG. 11C.

The above description is given by way of example, and not limitation. Given the above disclosure, one skilled in the art could devise variations that are within the scope and spirit of the invention disclosed herein, including various ways of positioning the Newtonian/non-newtonian combination within footwear. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A shock attenuation system, comprising:

a multi-layered system comprising a first layer and a second layer, said first layer comprising a flat moderating material that generally exhibits non-Newtonian behavior in response to impact force, said second layer comprising a cushioning material that generally exhibits Newtonian behavior in response to impact force, and an encapsulating envelope surrounding said moderating material, said encapsulating envelope limiting the lateral expansion of said moderating material in response to applied impact force.

2. A shock attenuation system according to claim 1, wherein said encapsulating envelope is comprised of one or more materials taken from the group including: encapsulating film envelopes, plastic film envelopes, polyurethane film envelopes, polymer-based envelopes, woven fabric envelopes, or combinations thereof.

3. A shock attenuation system, comprising:

a first cushioning region and a second cushioning region, said first cushioning region and said second cushioning region each comprising a multi-layered system with a first layer and a second layer, said first layer of said first region comprising a first moderating material that generally exhibits non-Newtonian behavior in response to impact force, said second layer of said first region comprising a first cushioning material that generally exhibits Newtonian behavior in response to impact force, said first layer of said second region comprising a second moderating material that generally exhibits non-Newtonian behavior in response to impact force, said second layer of said second region comprising a second cushioning material that generally exhibits Newtonian behavior in response to impact force.

4. A shock attenuation system according to claim 3, wherein said first moderating material comprises a dilatant material and said second moderating material comprises a thixotropic material.

5. A shock attenuation system according to claim 3, further comprising an encapsulating envelope surrounding one or more of the following: said first layer of said first region, said first layer of said second region.

6. A shock attenuation system according to claim 5, wherein said first and second cushioning materials are comprised of one or more materials taken from the group including: gas filled bladders, Ethylene-Vinyl Acetate, Polyurethane, foam materials, gel or gel-like materials, structural point-elastic cushioning systems, polymer based cushioning materials, or combinations thereof.

7. A shock attenuation system to attenuate an impact force, the shock attenuation system comprising:

a first material having an open structure that generally exhibits non-Newtonian behavior in response to the impact force;

a second material that generally exhibits Newtonian behavior in response to the impact force with the second material flowed through the open structure of the first material and the first material embedded within the second material.

8. The system of claim 7 wherein the first material comprises a plurality of fibers.

9. The system of claim 8 wherein a direction of fibers is generally parallel to a direction of the impact force.

10. The system of claim 7 wherein the second material is silicon.

11. The system of claim 7 wherein an upper surface of the second material is disposed above an upper surface of the first material.

12. The system of claim 7 wherein a lower surface of the second material is disposed below a lower surface of the second material.

13. The system of claim 7 wherein an upper surface of the second material is disposed above an upper surface of the first material and a lower surface of the second material is disposed below a lower surface of the second material.

* * * * *